United States Patent [19]

Fenton

[11] 4,093,931

[45] June 6, 1978

[54] MAGNETIC ARMATURE PIECE FOR ROTARY SOLENOID

[75] Inventor: Alvin P. Fenton, Oostburg, Wis.

[73] Assignee: Kohler Co., Kohler, Wis.

[21] Appl. No.: 798,293

[22] Filed: May 19, 1977

[51] Int. Cl.[2] ..... H01F 7/14

[52] U.S. Cl. ..... 335/272; 335/279

[58] Field of Search ..... 335/272, 279

[56] References Cited

U.S. PATENT DOCUMENTS

| | | | |
|---|---|---|---|
| 2,899,037 | 8/1959 | Pierce | 335/272 |
| 3,278,875 | 10/1966 | McDonough | 335/272 |
| 3,378,799 | 4/1968 | Quellette | 335/272 |

FOREIGN PATENT DOCUMENTS

| | | | |
|---|---|---|---|
| 1,102,811 | 2/1968 | United Kingdom | 335/272 |

*Primary Examiner*—George Harris

*Attorney, Agent, or Firm*—Quarles & Brady

[57] ABSTRACT

A magnetic armature piece particularly adapted for use with a rotary solenoid includes a pair of high permeability ferro-magnetic rotary poles which are fixed in relationship to each other by relatively thin bridges which connect magnetically neutral regions on the poles so that the required magnetic flux properties of the poles are not lost. Rotary solenoids in which the described magnetic armature piece is employed are more reliable than conventional solenoids because the poles cannot become misaligned during assembly or use.

2 Claims, 7 Drawing Figures

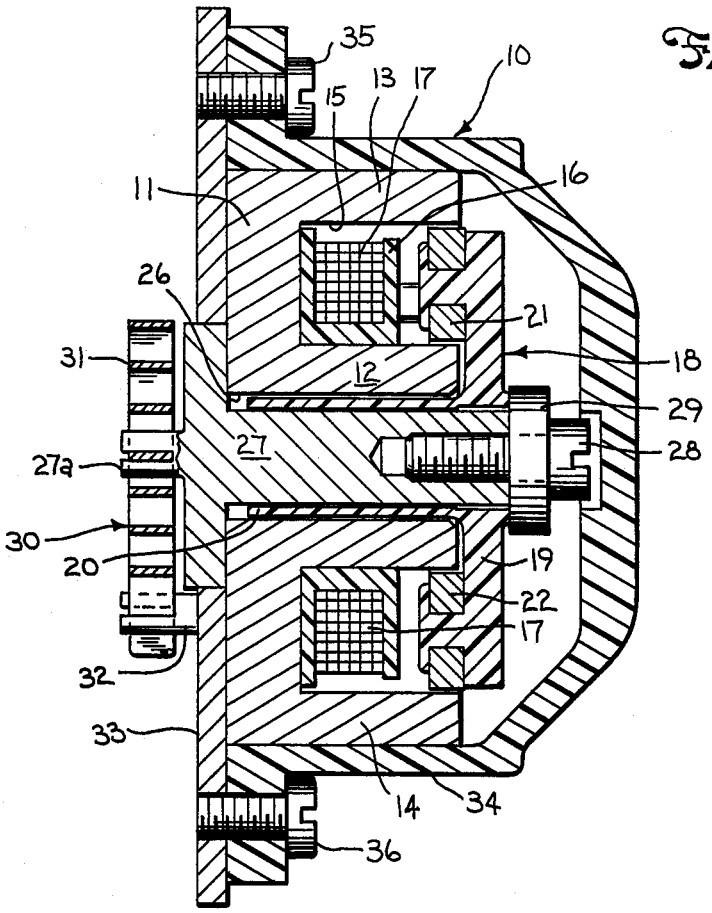
Fig. 1
Fig. 3
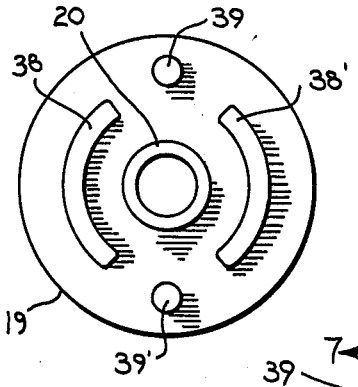
Fig. 4
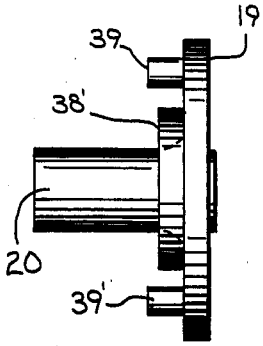
Fig. 5
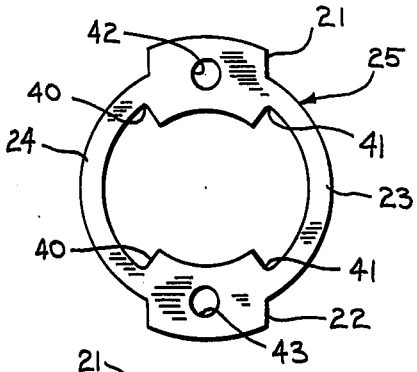
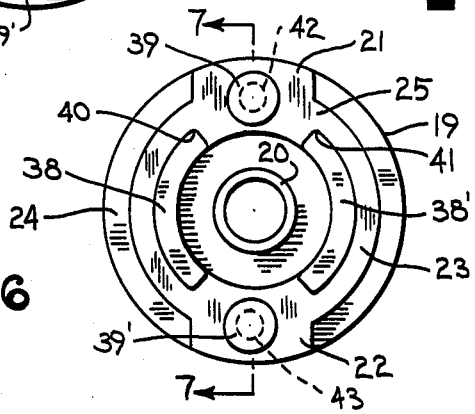
Fig. 6
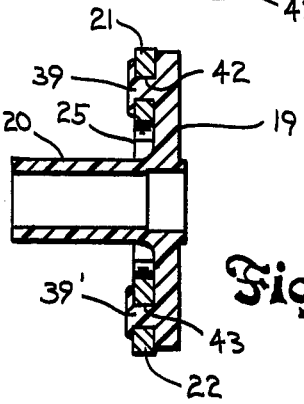
Fig. 7

MAGNETIC ARMATURE PIECE FOR ROTARY SOLENOID

BACKGROUND OF THE INVENTION

Rotary solenoids are known in which individual rotary pole pieces are riveted or otherwise attached to a rotor to form an armature. However, such rotary solenoids are not completely reliable because the individual pole pieces can become misaligned during assembly or use causing a rotary pole piece to contact a stationary pole and the solenoid to malfunction.

SUMMARY OF THE INVENTION

The present invention resides in a magnetic armature piece having a pair of spaced apart high permeability ferro-magnetic poles that are connected by relatively thin bridges which join the poles in magnetically neutral regions so that the required magnetic flux properties of the individual poles are not lost. The relationship of the poles of the magnetic armature piece to each other is fixed by the bridges so that the individual poles cannot be accidentally misaligned during assembly or use and cause the solenoid to malfunction.

One preferred form of the magnetic armature piece includes indentations on the armature piece which cooperate with positioning ridges on a rotor so that the magnetic armature piece can be quickly positioned in exact alignment on the rotor thereby reducing the chance of human error.

It is the general object of the present invention to disclose a magnetic armature piece in which the rotary poles of the armature are permanently fixed in the proper spaced relationship to each other so that they cannot become misaligned.

It is a further object of the invention to disclose a magnetic armature piece which includes two high permeability ferro-magnetic poles connected by bridges which join the poles in magnetically neutral regions.

It is a still further object to disclose a magnetic armature piece and a rotor which have cooperating alignment means that insure that the poles are properly aligned on the rotor.

These and further objects will be apparent from the description to follow.

BRIEF DESCRIPTION OF THE DRAWINGS

FIG. 1 is an enlarged sectional view of a rotary solenoid employing the present invention;

FIG. 3 is a reduced front view of the rotor of the solenoid of FIG. 1;

FIG. 4 is a side view of the rotor of FIG. 3;

FIG. 5 is a reduced front view of the magnetic armature piece of the solenoid of FIG. 1;

FIG. 6 is a front view of the assembled rotor and magnetic armature piece; and FIG. 7 is a sectional view taken along lines 7—7 of FIG. 6.

DESCRIPTION OF THE PREFERRED EMBODIMENT

Figure 2:
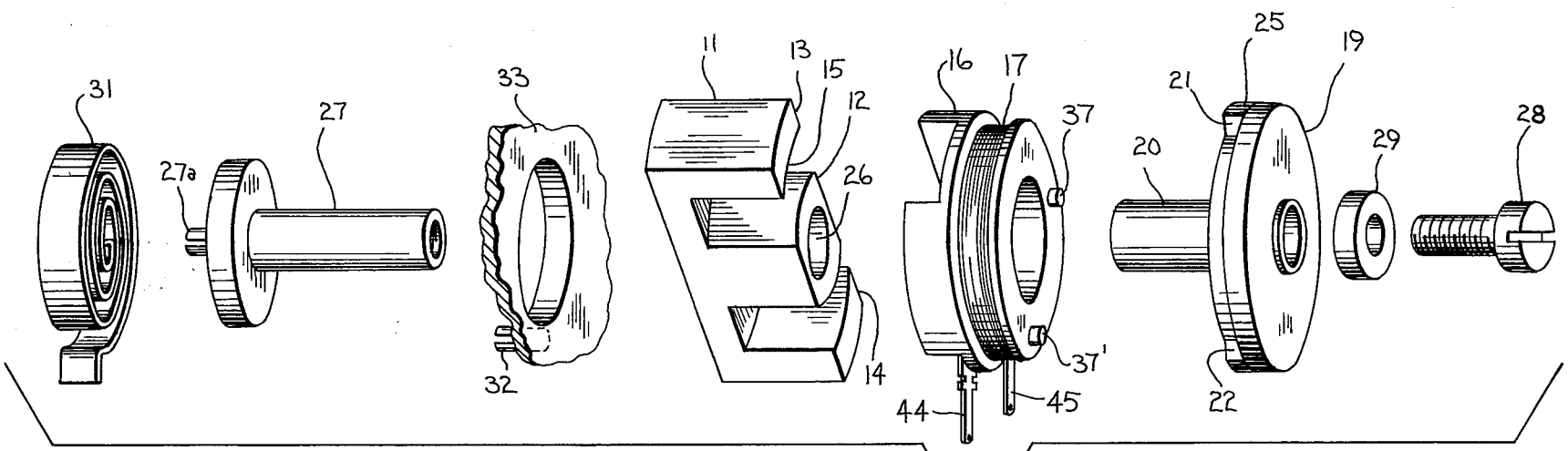
FIG. 2 is an exploded perspective view of the solenoid of FIG. 1.

Referring now to the drawings, in FIG. 1 there is seen a rotary solenoid, generally indicated as 10, having a stationary "E"-shaped electromagnet 11 with a central axial hub 12, a pair of opposed axially extending poles 13, 14 and a circular channel 15 between the hub 12 and the poles 13, 14.

As seen only in FIG. 1, a bobbin 16 carrying a solenoid coil 17 is positioned over the hub 12 of the "E"-shaped electromagnet 11 so that the solenoid coil 17 is located within the recess of the channel 15. The solenoid 10 further includes an armature assembly 18 which includes a rotor 19 of nonmagnetic material having an axially projecting sleeve 20 and a pair of diametrically opposed high permeability ferro-magnetic poles 21, 22. As seen best in FIG. 5, the poles 21, 22 are joined by relatively thin bridges 23, 24 to form a unitary magnetic armature piece 25.

Returning to FIG. 1, it can be seen that the armature assembly 18 is positioned so that the sleeve 20 projects through and is rotatable in an axial bore 26 in the hub 12 of the 37 E"-shaped electromagnet 11 and the rotary poles 21, 22 are recessed in and can be swung with a minimum of clearance through the channel 15. The rotor 19 of armature assembly 18 is coupled at one end to an output shaft 27 by a threaded fastener 28 which extends through a retaining washer 29. The other end *27a* of the output shaft 27 is keyed to a return spring mechanism 30 which returns the armature assembly 18 to its starting position in which the rotary poles 21, 22 are not aligned with the stationary poles 13, 14 when the solenoid coil 17 is de-energized. The return spring mechanism 30 is preferably in the form of a spiral strip 31 which is keyed to a slotted lug 32 on a support 33. The described solenoid components are enclosed in a housing 34 which is anchored by suitable fasteners 35, 36 to the support 33.

Turning now to FIG. 2 in which the internal components of the solenoid can be seen in greater detail, it is seen that the outer face of the bobbin 16 is provided with a pair of spaced apart outwardly projecting lugs 37, 37'. When the solenoid is assembled as seen in FIG. 1, the lugs 37, 37' cooperate with the poles 21, 22 to limit the rotary movement of the output shaft 27. The lugs 37, 37' also serve to properly position the rotary poles 21, 22 when the armature assembly 18 is returned to its starting position by the return spring mechanism 30.

Turning now to FIGS. 3 to 7, it can be seen that in its preferred form the rotor 19 has a pair of arcuate positioning ridges 38 and 38' which are coaxial with the sleeve 20 and a pair of diametrically opposed rivets 39, 39' (best seen in FIGS. 3 and 4) and that the magnetic armature piece 25 has a pair of arcuate positioning ridgereceiving indentations 40, 41 and a pair of diametrically opposed rivet-receiving apertures 42 and 43. In FIGS. 6 and 7, it can be seen that in the finally assembled armature assembly 18 the positioning ridges 38 and 38' are received in the indentations 40 and 41, respectively, and the rivets 39, 39' which extend through the apertures 42 and 43 have been staked to immobilize the poles 21, 22 on the rotor 19 and prevent any possibility of the poles becoming misaligned. Obviously, if desired, other means than the rivets could be used to permanently attach the magnetic armature piece 25 to the rotor 19. For example, the armature piece 25 could be embedded in the plastic material of the rotor during the process of molding the rotor.

Referring now specifically to FIG. 5, it can be seen that in its preferred embodiment the magnetic armature piece 25 is in the form of an annular ring in which the poles 21, 22 are diametrically opposed and are joined by the relatively thin bridges 23, 24. The bridges 23, 24 are connected to the poles 21, 22 in magnetically neutral regions so that the magnetic flux properties of the poles are not adversely affected. Although the bridges 23, 24 have been described as "thin" it will be appreciated that the use of the term is in a relative sense. It is only necessary that bridges 23, 24 be so sized that when as in the preferred form, they are constructed of the same ferromagnetic material as the poles they will not adversely affect the magnetic flux of the poles so as to interfere with the proper function of the poles. The construction of the poles and the bridges as a single piece insures that the poles are always fixed in a properly spaced apart relationship from which they cannot be dislodged or misaligned. It is very important that the poles be fixed and immobilized because there is in the assembled solenoid, as seen in FIG. 1, only a very slight clearance between outermost surfaces of the poles 21, 22 and innermost surfaces of the stationary poles 13, 14 of the "E"-shaped electromagnet 11 and if the rotary poles are misaligned and contact the stationary poles, the solenoid will malfunction.

When the described rotary solenoid 10 is energized by applying a d-c voltage to the leads 44, 45 (seen only in FIG. 2) of the solenoid coil 17, the coil 17 generates a magnetic field which causes the poles 21, 22 of the armature assembly to seek alignment with the stationary poles 13, 14 of the "E"-shaped electromagnet 11. The torque thus generated causes the output shaft 27 to overcome the resistance of the return spring mechanism 30 and rotate approximately 30° from the de-energized starting position to a fully energized position. The shaft is prevented from rotating further than desired in either direction by contact between lugs 37 and 37′ and the poles 21 and 22. Upon deenergization of the solenoid coil 17, the return spring mechanism 30 returns the output shaft 27 and attached armature assembly 18 to the starting position.

The rotary solenoid of the present invention may be employed for a wide variety of purposes. However, one particularly preferred use is in conjunction with an internal combustion engine in which the solenoid is used to automatically control the choke as described in my U.S. Pat. No. 3,978,853 titled Automatic Choke Assembly for Small Engines, issued Sept. 7, 1976. When employed with an internal combustion engine, the leads 44, 45 of the solenoid coil 17 can be connected into the starter circuit so that the solenoid coil 17 is energized whenever the engine is cranked.

It will be readily apparent to those skilled in the art that a number of modifications and changes can be made without departing from the spirit and scope of the invention. For example, if desired, the bridges connecting the poles of the magnetic armature piece could be of a different material than the poles themselves. Therefore, it is to be understood that the invention is not to be limited by the showing or description herein, or in any other manner, except as may be specifically required.

I claim:

1. In a rotary solenoid which includes a stationery "E"-shaped electromagnet having a central axial hub with a central axial opening, a pair of opposed axially extending poles and a circular channel between said hub and said poles, a solenoid coil positioned in said channel about said hub, and an armature assembly having a rotor, an output shaft affixed to the rotor which extends through the axial opening in the hub and a pair of diametrically opposed magnetic poles, the improved armature assembly in which:

(a) the output shaft is formed integral with the rotor;

(b) the poles are joined in a fixed relationship by relatively thin bridges to form a unitary magnetic armature piece; and (c) the magnetic armature piece and the rotor are each provided with alignment means which cooperate to properly align the magnetic armature piece on the rotor.

2. The solenoid of claim 1 in which the alignment means on the rotor is a pair of positioning ridges and a pair of rivets and the alignment means on the magnetic armature piece is a pair of arcuate ridge-receiving indentations and a pair of rivet receiving apertures.

* * * * *